US007712928B2

(12) United States Patent
Kuo et al.

(10) Patent No.: US 7,712,928 B2
(45) Date of Patent: May 11, 2010

(54) STREET ILLUMINATING DEVICE

(75) Inventors: Yuan-Lung Kuo, Taipei Hsien (TW); Da-Wei Lin, Taipei Hsien (TW); Han-Lung Lee, Taipei Hsien (TW); Sei-Ping Louh, Taipei Hsien (TW); Tai-Cherng Yu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/202,595

(22) Filed: Sep. 2, 2008

(65) Prior Publication Data

US 2009/0237929 A1 Sep. 24, 2009

(30) Foreign Application Priority Data

Mar. 24, 2008 (CN) ..... 2008 1 0300686

(51) Int. Cl.
*F21V 29/00* (2006.01)

(52) U.S. Cl. ..... 362/294; 362/218; 362/217.15; 362/241

(58) Field of Classification Search ..... 362/97.2, 362/97.3, 97.4, 218, 240, 241, 249.02, 294, 362/373, 633, 800, 217.11, 217.15
See application file for complete search history.

(56) References Cited

U.S. PATENT DOCUMENTS

| | | | | |
|---|---|---|---|---|
| 4,733,335 | A * | 3/1988 | Serizawa et al. | 362/800 |
| 2006/0164858 | A1* | 7/2006 | Park et al. | 362/373 |
| 2007/0103908 | A1* | 5/2007 | Tabito et al. | 362/294 |
| 2007/0189011 | A1* | 8/2007 | Song et al. | 362/294 |
| 2008/0232118 | A1* | 9/2008 | Liu | 362/373 |
| 2009/0262542 | A1* | 10/2009 | Li et al. | 362/373 |

* cited by examiner

*Primary Examiner*—Y My Quach Lee
(74) *Attorney, Agent, or Firm*—Andrew C. Cheng

(57) ABSTRACT

A street illuminating device includes a retaining frame, a light source module, and a heat dissipating module. The light source module includes a printed circuit board retained in the retaining frame, a number of solid state lighting elements, and a light reflecting plate. The printed circuit board has a first surface and an opposite second surface. The solid state lighting elements are arranged on the first surface of the printed circuit board. The light reflecting plate includes a number of through holes with inner reflecting surfaces. The light reflecting plate is disposed on the first surface of the printed circuit board with the solid state lighting elements received in the respective through holes. The heat dissipating module is in thermal contact with the second surface of the printed circuit board.

13 Claims, 3 Drawing Sheets

STREET ILLUMINATING DEVICE

BACKGROUND

1. Technical Field

The present invention relates to illuminating devices, and particularly, to a street illuminating device with a number of solid state light emitting elements.

2. Description of Related Art

Solid state light emitting elements, such as light emitting diodes (LEDs) have been widely used in street illuminating devices.

An LED is capable of producing a visible light in a certain wavelength. However, 80% to 90% energy of the LED is converted to heat, which needs to be dissipated, and only the small remainder is converted to the light.

The light from an LED needs to be gathered if a higher light concentration and brightness are needed. However, if a number of LEDs are used, it becomes complicated to efficiently gather light for each LED.

What is needed, therefore, is a street illuminating device with a number of solid state light emitting elements, which is compact, and in which light gather and heat dissipation are simply accomplished.

SUMMARY

A street illuminating device includes a retaining frame, a light source module, and a heat dissipating module. The light source module includes a printed circuit board retained in the retaining frame, a number of solid state lighting elements, and a light reflecting plate. The printed circuit board has a first surface and an opposite second surface. The solid state lighting elements are arranged on the first surface of the printed circuit board. The light reflecting plate includes a number of through holes with inner reflecting surfaces. The light reflecting plate is disposed on the first surface of the printed circuit board with the solid state lighting elements received in the respective through holes. The heat dissipating module is in thermal contact with the second surface of the printed circuit board.

Other advantages and novel features of the present street illuminating device will become more apparent from the following detailed description of embodiment when taken in conjunction with the accompanying drawings.

BRIEF DESCRIPTION OF THE DRAWINGS

Many aspects of the street illuminating device can be better understood with reference to the following drawings. The components in the drawings are not necessarily drawn to scale, the emphasis instead being placed upon clearly illustrating the principles of the present street illuminating device. Moreover, in the drawings, like reference numerals designate corresponding parts throughout the several views.

DETAILED DESCRIPTION OF THE EMBODIMENTS

Embodiment of the present street illuminating device will now be described in detail below and with reference to the drawings.

Figure 1:
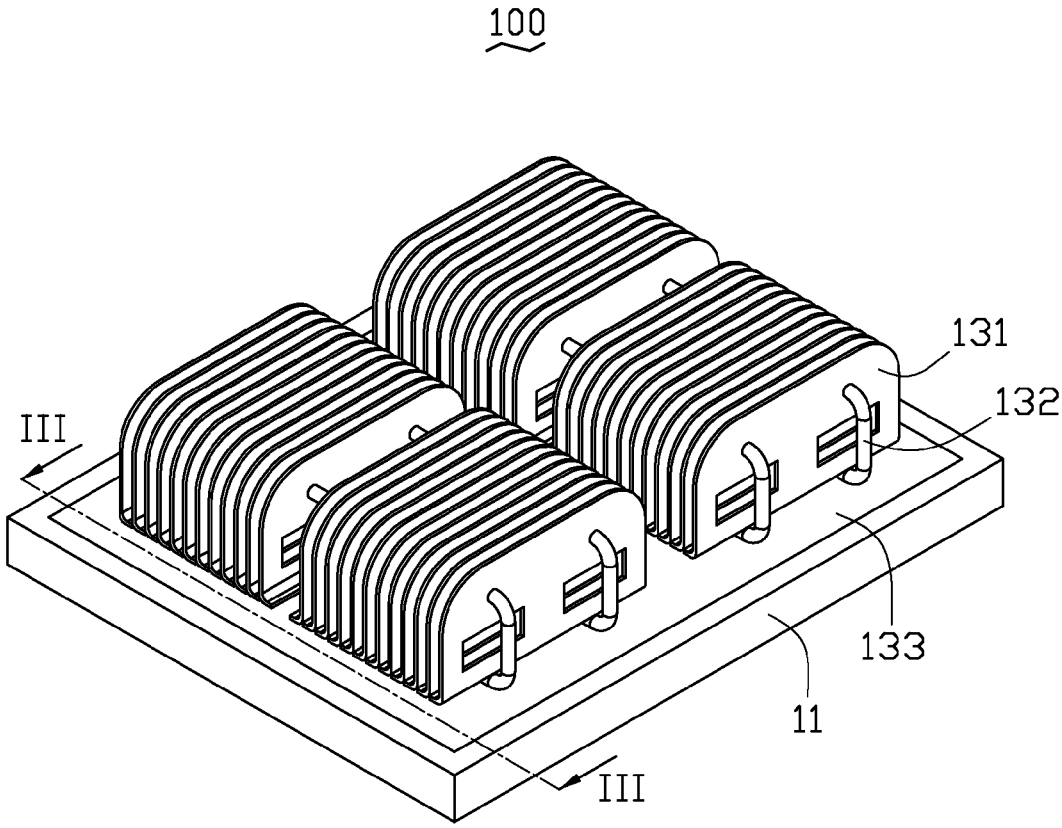
FIG. 1 is a schematic view of a street illuminating device in accordance with an embodiment of present invention.
Figure 2:
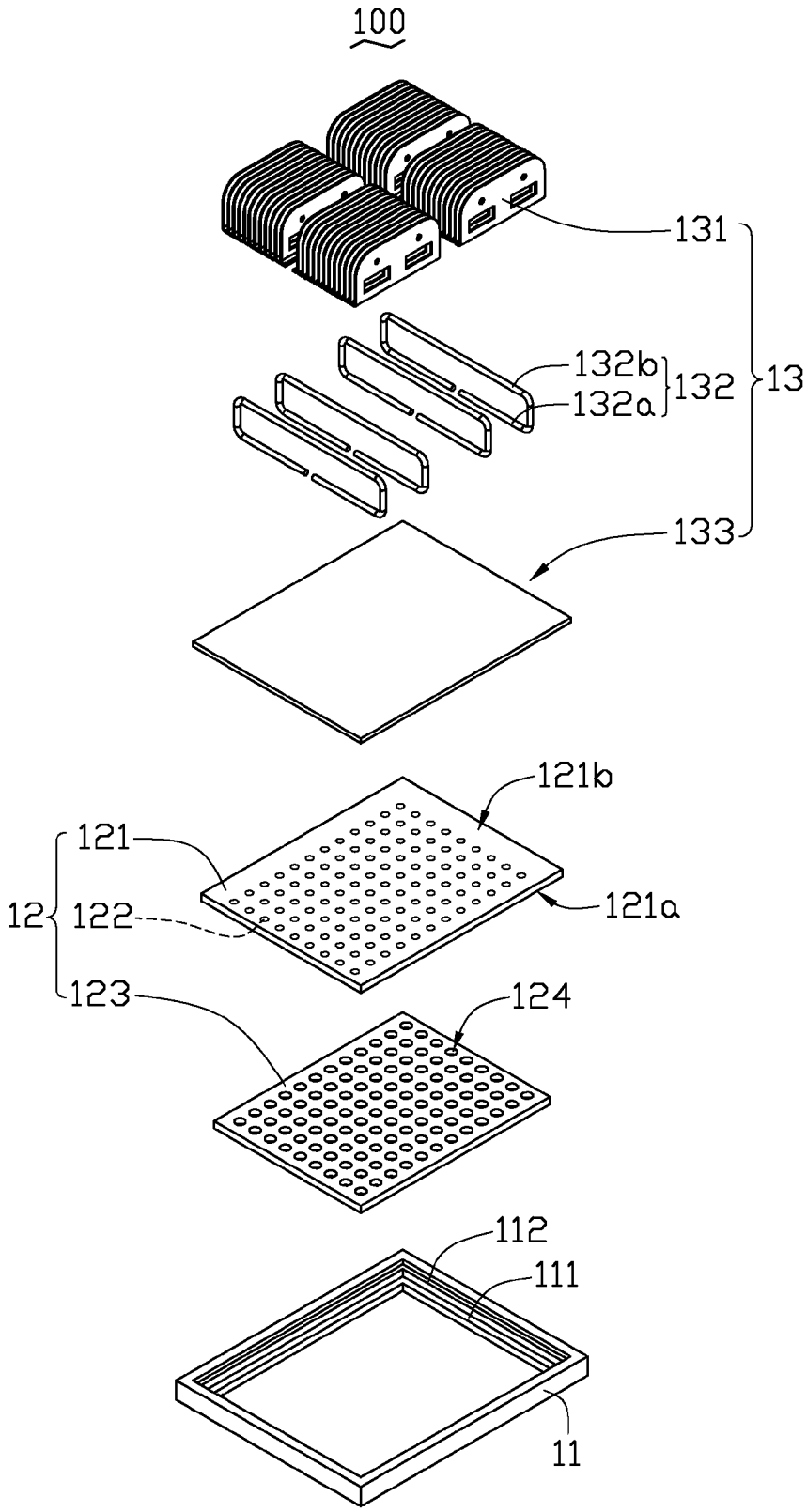
FIG. 2 is an exposed view of the street illuminating device shown in FIG. 1.

Referring to FIGS. 1 and 2, a street illuminating device 100 is provided. The street illuminating device 100 includes a retaining frame 11, a light source module 12, and a heat dissipating module 13.

Figure 3:
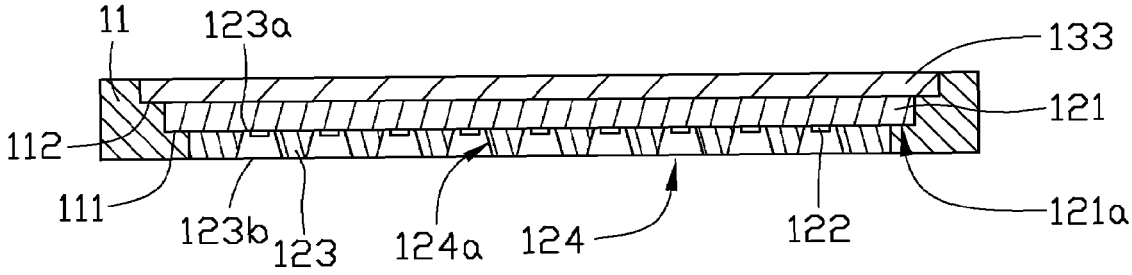
FIG. 3 is a cross-sectional view of the street illuminating device shown in FIG. 1 taken along a III-III line.

Also referring to FIG. 3, the retaining frame 11 has a first retaining step 111 and a second retaining step 112 formed in an inner wall thereof. The second retaining step 112 is adjacent to the first retaining step 111. The retaining frame 11 can be made from aluminum material.

The light source module 12 includes a printed circuit board 121, a number of solid state lighting elements 122, and a light reflecting plate 123. The printed circuit board 121 is retained on the first step 111 of the retaining frame 11. The printed circuit board 121 has a first surface 121*a* and an opposite second surface 121*b*. Each of the solid state lighting elements 122 is an LED. The solid state lighting elements 122 are arranged the first surface 121*a* of the printed circuit board 121, and are evenly spaced apart from each other. The light reflecting plate 123 is engaged with an inner wall of the retaining frame 11. The light reflecting plate 123 includes a number of through holes 124 with inner reflecting surfaces 124*a*. The through holes 124 each are truncated cone shaped, and have a smaller opening 123*a* and a larger opening 123*b*. The light reflecting plate 123 is attached on the first surface 121*a* of the printed circuit board 121, with each of the solid state lighting elements 122 received in the respective one of the through holes 124. The smaller opening 123*a* of each of the through holes 124 is adjacent to the respective one of the solid state lighting elements 122, and the larger opening 123*b* of each of the through holes 124 is apart from the respective one of the solid state lighting elements 122.

The heat dissipating module 13 includes a heat conduction plate 133, a number of ring-shaped heat pipes 132 with working fluid (not shown) therein, and a number of heat sinks 131. The heat conduction plate 133 is retained on the second retaining step 112 of the retaining frame 11. The heat conduction plate 133 can be made from the same material as the retaining frame 11, or from some other material with heat transfer capability higher than that of the material of the retaining frame 11. The heat conduction plate 133 is in thermal contact with the second surface 121*b* of the printed circuit board 121. Each of the ring-shaped heat pipes 132 has an evaporator section 132*a*, and a condenser section 132*b*. The evaporator sections 132*a* of the heat pipes 132 are in thermal contact with the heat conduction plate 133. The condenser sections 132*b* of the heat pipes 132 penetrate through the heat sinks 131, such that the heat sinks 131 are in thermal contact with the heat pipes 132.

Due to the compact nature of the retaining frame 11, the entire street illuminating device 20 is compact. Due to the reflectivity of the respective inner reflecting surfaces 124*a* of the light reflecting plate 123, light emitted by the respective solid state lighting elements 122 can be gathered and output only from the respective through holes 124, thus reducing light loss, increasing brightness, and providing a higher light concentration. Heat generated by the solid state lighting elements 122 can be conducted out by the heat conduction plate 133 and also by the retaining frame 11. Configuration and cooperation of the ring-shaped heat pipes 132 with the heat sinks 131 help provide a compact efficient module.

It is understood that the above-described embodiments are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. A street illuminating device, comprising:

a hollow retaining frame comprising an inner space, a first opening and an opposite second opening, the first opening and the second opening communicating the inner space with outside;

a light source module retained in the inner space of the retaining frame, the light source module comprising a printed circuit board, a plurality of solid state lighting elements; and a light reflecting plate comprising a plurality of through holes with inner reflecting surfaces therein, the printed circuit board having a first surface and an opposite second surface, the solid state lighting elements arranged on the first surface of the printed circuit board, the light reflecting plate being disposed on the first surface of the printed circuit board, with the solid state lighting elements received in the respective through holes and facing the first opening; and a heat dissipating module in thermal contact with the second surface of the printed circuit board, the heat dissipating module exposed to the outside through the second opening and configured for conducting heat from the printed circuit board to the outside.

2. The street illuminating device of claim 1, wherein the retaining frame further comprises a first retaining step and an adjacent second retaining step formed in an inner wall of the retaining frame, the printed circuit board being retained on the first retaining step.

3. The street illuminating device of claim 2, wherein the heat dissipating module comprises a heat conduction plate retained on the second retaining step and in thermal contact with the second surface of the printed circuit board, a plurality of heat pipes with working fluid therein in contact with the heat conduction plate, and a plurality of heat sinks in thermal contact with the heat pipes, the heat pipes and the heat sinks are arranged outside of the retaining frame.

4. The street illuminating device of claim 3, wherein the retaining frame and the heat conduction plate are made of a same material.

5. The street illuminating device of claim 3, wherein each of the heat pipes comprises an evaporator section in contact with the heat conduction plate, and a condenser section penetrating through the heat sinks.

6. The street illuminating device of claim 3, wherein the printed circuit board, the heat conduction plate and the light reflecting plate each are engaged with the inner wall of the retaining frame, the retaining frame defines a first outside surface adjacent to the first opening and an opposite second outside surface adjacent to the second opening, the light reflecting plate has a surface coplanar with the first outside surface, the heat conduction plate has a surface coplanar with the second outside surface.

7. The street illuminating device of claim 1, wherein each of the through holes of the light reflecting plate is truncated cone shaped and tapers in a direction toward the respective solid state lighting element.

8. A street illuminating device, comprising:

a hollow retaining frame comprising an inner space, a first outside surface and an opposite second outside surface, a first opening at the first outside surface and a second opening at the second outside surface, the first opening and the second opening communicating the inner space with outside;

a light source module retained in the inner space of the retaining frame, the light source module comprising a printed circuit board, a plurality of solid state lighting elements and a light reflecting plate comprising a plurality of through holes with inner reflecting surfaces therein, the printed circuit board having a first surface and an opposite second surface, the solid state lighting elements arranged on the first surface of the printed circuit board, the light reflecting plate being disposed on the first surface of the printed circuit board, with a surface thereof coplanar with the first outside surface of the retaining frame and the solid state lighting elements received in the respective through holes and facing the first opening; and a heat dissipating module comprising a heat conduction plate, the heat conduction plate defining a first conducting surface in thermal contact with the second surface of the printed circuit board, and an opposite second conducting surface coplanar with the second outside surface of the retaining frame, the heat dissipating module conducting heat from the printed circuit board to the outside through the second opening.

9. The street illuminating device of claim 8, wherein the retaining frame further comprises a first retaining step and an adjacent second retaining step formed in an inner wall of the retaining frame, the first retaining step and the second retaining step divide the inner space of the retaining frame into three receiving regions, and the light reflecting plate, the printed circuit board and the heat conduction plate are received in sequence in the three receiving regions, respectively.

10. The street illuminating device of claim 9, wherein the printed circuit board and the heat conduction plate are disposed on the first retaining step and the second retaining step, respectively, and the light reflecting plate is engaged with the inner wall of the retaining frame.

11. The street illuminating device of claim 8, wherein the retaining frame and the heat conduction plate are made of a same material.

12. The street illuminating device of claim 8, wherein the heat dissipating module further comprises a plurality of heat pipes with working fluid therein in contact with the heat conduction plate, and a plurality of heat sinks in thermal contact with the heat pipes, the heat pipes and the heat sinks are arranged outside of the retaining frame.

13. The street illuminating device of claim 8, wherein each of the through holes of the light reflecting plate is truncated cone shaped and tapers in a direction toward the respective solid state lighting element.

* * * * *